United States Patent [19]

Dunlap

[11] 4,413,613

[45] Nov. 8, 1983

[54] SLEEVE DAMPER APPARATUS

[75] Inventor: David A. Dunlap, Warrenville, Ill.

[73] Assignee: Jefco Laboratories, Inc., Chicago, Ill.

[21] Appl. No.: 284,495

[22] Filed: Jul. 17, 1981

[51] Int. Cl.[3] ..... F23L 3/00

[52] U.S. Cl. ..... 126/292; 126/285 B

[58] Field of Search ..... 126/285 R, 285 B, 285 A, 126/289–293, 307 R, 312; 431/20; 236/1 G

[56] References Cited

U.S. PATENT DOCUMENTS

| | | | |
|---|---|---|---|
| 361,301 | 4/1887 | Lederle | 126/292 |
| 411,603 | 9/1889 | Mohrmann | 126/292 |
| 971,285 | 9/1910 | Leo et al. | 126/295 |
| 1,972,677 | 9/1934 | Bourheim | 126/292 |

FOREIGN PATENT DOCUMENTS

| | | | |
|---|---|---|---|
| 2801360 | 7/1979 | Fed. Rep. of Germany | 126/285 B |
| 3002634 | 7/1981 | Fed. Rep. of Germany | 126/285 B |

*Primary Examiner*—James C. Yeung

*Attorney, Agent, or Firm*—Merriam, Marshall & Bicknell

[57] ABSTRACT

A damper device insertable into a slotted duct or flue without cutting completely through the duct, including a sleeve conforming to the duct cross-section and adapted for insertion through the slot to nest within the un-cut duct portion. A damper plate with stiffener ribs is rotatably mounted within the sleeve. An apertured cover plate slightly larger than the duct slot size is located to overlap the slot for mounting the damper device to the duct, and a spacer plate may be placed intermediate and rigidly attached to the cover plate and the sleeve for reinforcing the support at one end of a damper shaft. The damper shaft may be rotated manually or by means of a motor mounted by a bracket to the cover plate.

7 Claims, 4 Drawing Figures

SLEEVE DAMPER APPARATUS

This invention relates to damper devices for ducts or flues of heat producing units, and in particular to an improved damper device particularly adaptable for installation in existing ducts or flues.

BACKGROUND OF THE INVENTION

Reference may be made to the following United States Patents of interest: U.S. Pat. Nos. 4,193,541; 4,132,354; 1,872,213; 1,630,591; 3,860,038; 3,749,108.

It is desirable to provide a damper device which may be readily installed into conduits, such as ducts or flues of existing heat producing units such as in homes, industrial plants, etc., and which may also be readily included with new installations of such heat producing units. Typically, the installation of presently existing damper devices requires a portion of an existing flue to be cut out and removed so that the damper device and a corresponding flue adapter portion may be fitted therein. An example of such a prior device is shown for instance in the aforementioned U.S. Pat. No. 4,193,541. The disadvantage of such units is that they require both cut ends of the flue to be supported while the damper unit is installed.

Therefore, it is particularly desired to provide a damper device which can be installed in existing flues without cutting through the flue and removing a complete portion of the flue, and yet enabling the damper device also to be readily installed in new installations.

SUMMARY OF THE INVENTION

In accordance with the principles of the present invention, there is provided an improved damper device which may be inserted into a slot provided in a conduit, such as a duct or a flue without cutting completely through the duct. In particular, there is provided a sleeve which conforms to the duct cross-section and is adapted for insertion through the slot provided in the duct so as to nest within the un-cut portion of the duct. A damper plate is rotatably mounted within the sleeve, with a damper shaft extending through the sleeve for rotating the damper plate from the duct exterior. An apertured cover plate slightly larger than the duct slot is located so as to extend over the slot with a portion overlapping onto the duct on either side of the slot. Mounting means, such as sheet metal screws may then be inserted through the cover plate and into the overlapped duct portion so as to securely mount the damper device to the duct. A spacer plate is adapted for location and attachment between the cover plate and the sleeve.

The damper plate position may be manually adjusted by rotating the damper shaft. Alternatively, a damper motor may be provided coupled to the damper shaft for positioning the damper as desired. Bracket means are provided for mounting a motor to the cover plate.

In accordance with the principles of the invention, the damper device may be readily installed in an existing system by merely cutting a slot in an existing flue, inserting the sleeve through the slot to nest in the un-cut portion on the flue and rigidly attaching the cover plate to the flue. This same installation sequence may be used for installing the damper device according to the present invention in new installations.

BRIEF DESCRIPTION OF THE DRAWINGS

The features of this invention which are believed to be novel are set forth with particularity in the appended claims. The invention may be best understood by reference to the following description taken in conjunction with the accompanying drawings, in which like reference numerals identify like elements in the several figures and in which:

DETAILED DESCRIPTION

Figure 1:
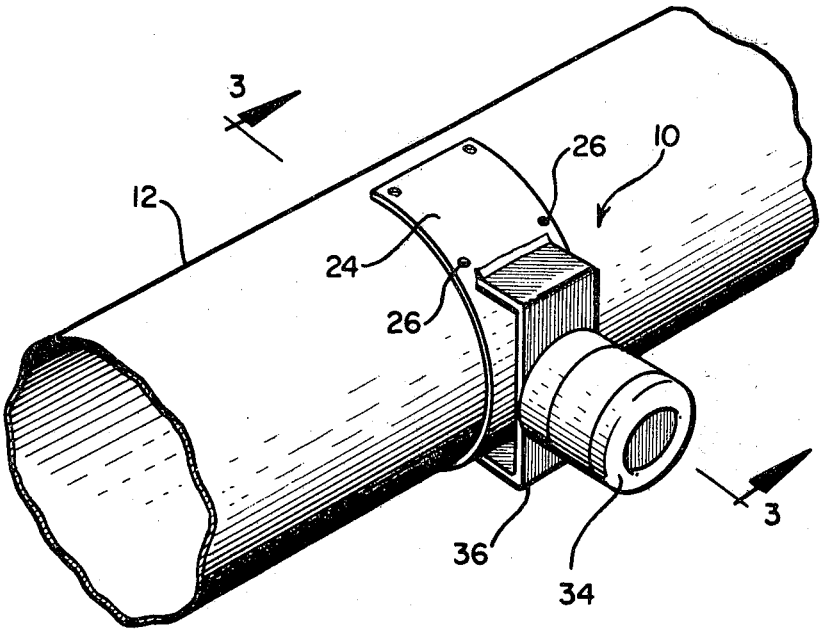
FIG. 1 is a perspective view illustrating a damper device constructed in accordance with the principles of the present invention and installed on a conduit, such as a duct or flue.
Figure 2:
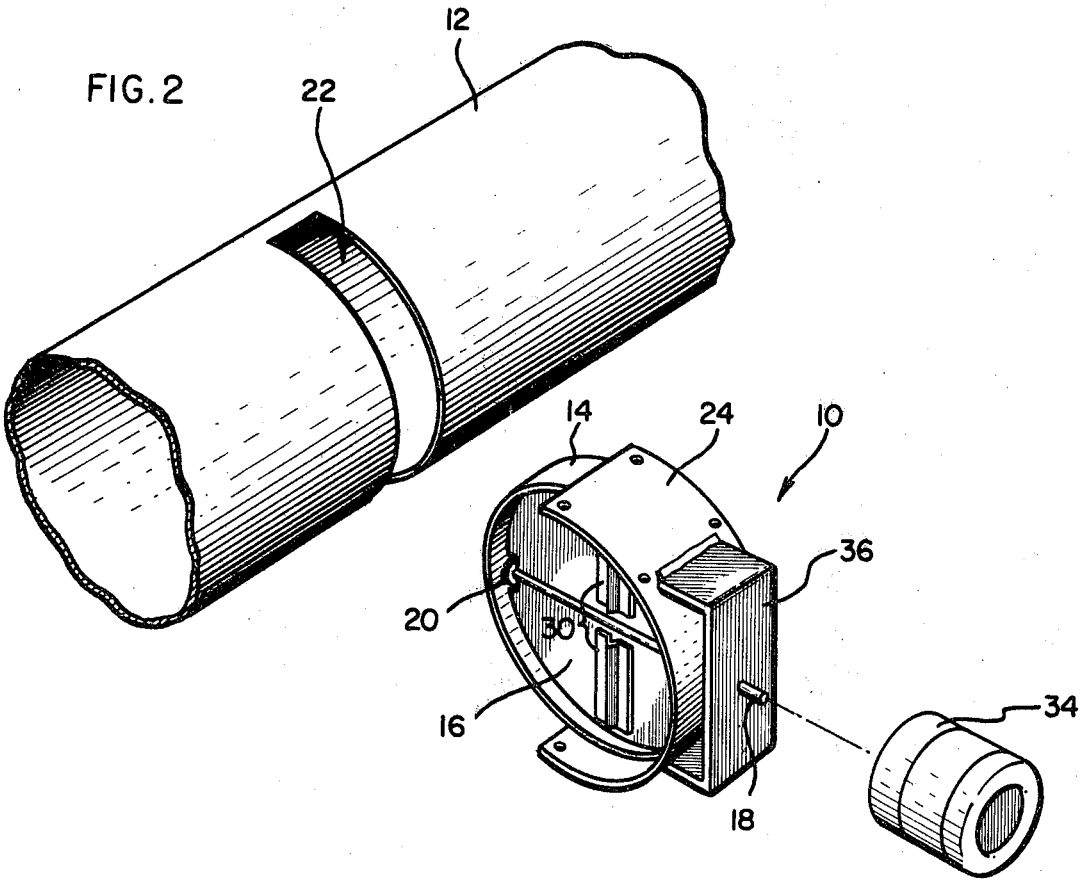
FIG. 2 is a perspective view of the device of FIG. 1 in exploded portions illustrating a slotted duct, a damper device according to the invention, and damper drive motor.

Referring now to FIGS. 1-4, there is illustrated a preferred embodiment of a damper device 10 according to the principles of the present invention mounted on a conduit 12 for controlling the flow of gases, such as air, or the products of combustible gases through the conduit. It is to be understood that damper device 10 may be installed on either a flue which vents combustible products from a heating unit to the atmosphere, or in a duct which conveys heated air from the heating unit to various locations in a building, such as a home, apartment, industrial building, etc. Thus, as used herein, the terms "duct" or "flue" may be used interchangeably, as they merely refer to a particular conduit 12 upon which damper device 10 is mounted.

In addition, while the damper device is shown mounted on a conduit 12 having a circular cross-section, the damper device may also be mounted on rectangular or square cross-section conduits following the principles of the present invention. Accordingly, the illustrations and the following description of a preferred embodiment are not meant to limit the present invention to the illustrated embodiment.

The damper device includes a circular sleeve 14 having an outer diameter matching the inner diameter of conduit 12. A circular damper plate 16 having a diameter slightly less than the sleeve is mounted to a shaft 18 which in turn is rotatably mounted to the sleeve by means of a pair of bushings 20 welded to the inside of the sleeve. Sleeve 14 includes a suitable aperture enabling damper shaft 18 to pass through the sleeve and exit at the exterior of the conduit.

Figure 3:
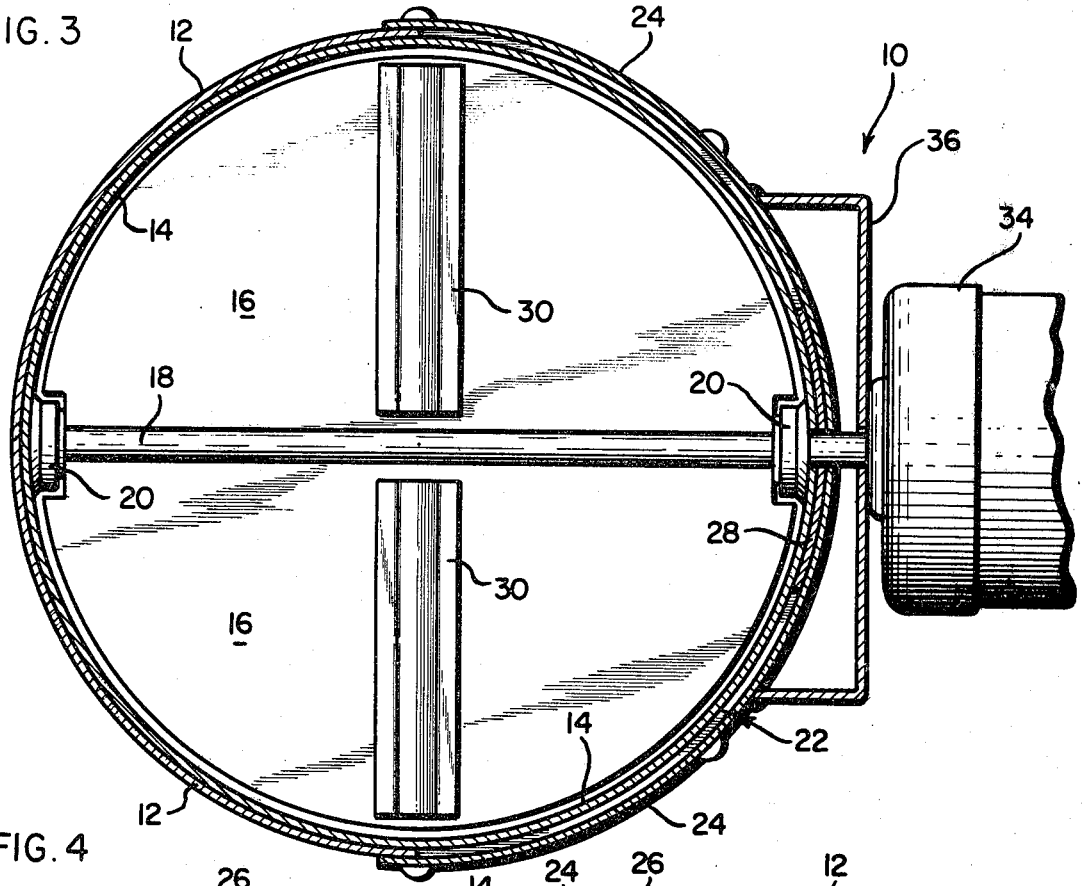
FIG. 3 is a sectional view taken along section lines 3—3 of FIG. 1.

A slot 22 is cut into conduit 12 transverse to the longitudinal axis of the conduit so as to extend about halfway or substantially one hundred eighty degress (180°) around conduit 12 and with a width slightly larger than the width of sleeve 14. With reference to FIG. 3, it can be seen that the sleeve is adapted to inserted through slot 22 so as to be supportedly nested within the un-cut portion of the conduit.

Figure 4:
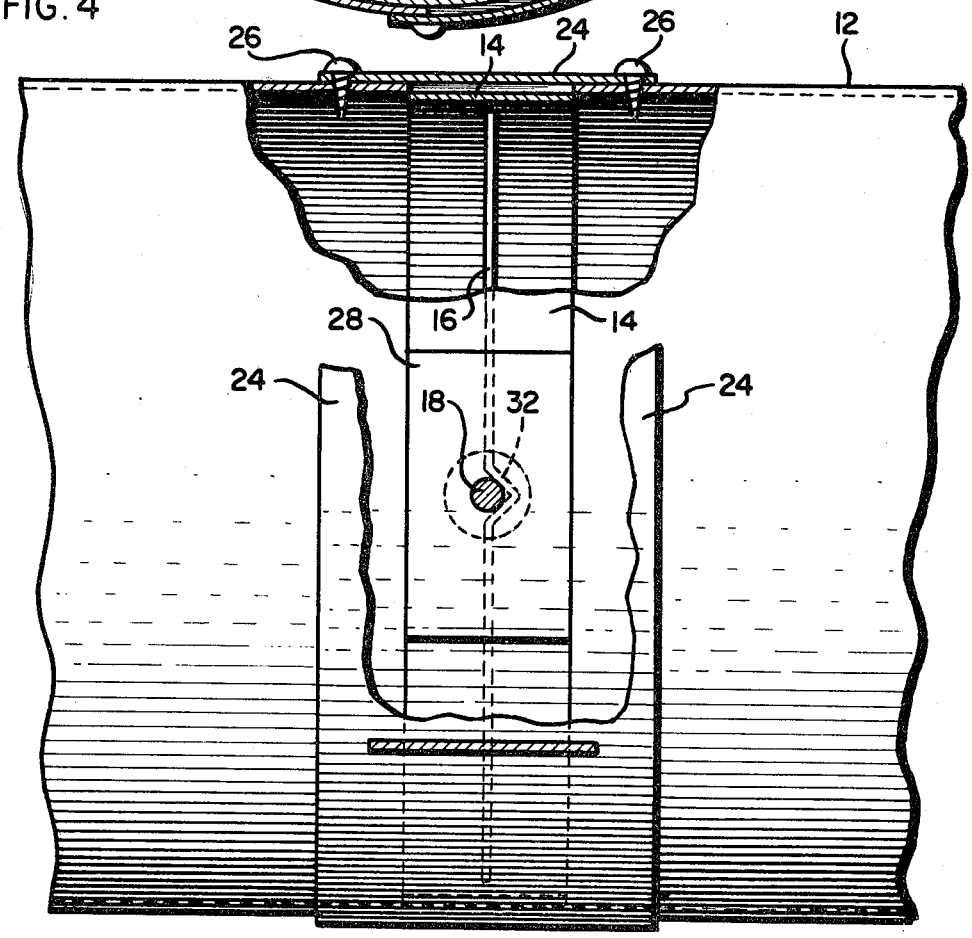
FIG. 4 is a fragmented, partly cut away view illustrating a damper device according to the invention.

A cover plate 24 is formed with a radius slightly larger than the sleeve, and includes an arcuate length slightly longer than the arcuate length of slot 22, and a width slightly wider than the width of slot 22. Thus, cover plate 24 is adapted to overlap slot 22 when placed on conduit 12 as shown in FIGS. 3 and 4. Cover plate 24 includes a suitable aperture permitting passage of damper shaft 18. Mounting means, such as sheet metal screws 26 are inserted through cover plate 24 and into conduit 12 immediately adjacent slot 22 so as to rigidly mount the damper device to the conduit.

An apertured spacer plate 28 is located on shaft 18 between cover plate 24 and sleeve 14 so as to substantially uniformly conform the cover plate to the conduit throughout its length. As shown most clearly in FIG. 3, spacer plate 28 is sized so as to fill in the gap between sleeve 14 and the support at one end of shaft 18. The spacer plate is rigidly attached, such as by welding, to sleeve 14 and cover plate 24. A pair of stiffeners 30 comprising longitudinal ribbed members are spot welded to one surface of damper plate 16 so as to stiffen the damper plate. Damper plate 16 includes a V-shaped portion 32 which may be rigidly attached by self-tapping sheet metal screws or by spot welding to shaft 18.

Shaft 18 may be rotated manually to position the damper plate or rotated by means of a motor in response to venting of combustible products from a heat producing unit. In such instances, a motor 34 with an integral bracket 36 can be mounted to the damper device by welding bracket 36 to the cover plate. It is to be understood, of course, that rather than the direct drive motor configuration illustrated herein, other configurations, such as a link drive motor bracket assembly suitably mounted to the cover plate may be provided.

The foregoing detailed description has been given for clearness of understanding only, and no unnecessary limitations should be understood therefrom, as modifications will be obvious to those skilled in the art.

What is claimed is:

1. A damper device for insertion into a transverse slot provided in an elongated duct transverse to the duct longitudinal axis without cutting completely through said duct, said damper device comprising:

a sleeve having an outer surface conforming to the cross-section of said duct and to the transverse slot in the duct and adapted for insertion through said transverse slot provided in said duct so as to nest within the un-cut portion of said duct;

a damper plate rotatably mounted within said sleeve, including a damper drive shaft extending through said sleeve for rotating said damper plate from at least one exterior side of said duct;

a cover plate having an aperture for passage of said damper drive shaft therethrough;

said cover plate having a width slightly larger than said transverse slot and adapted to extend over said transverse slot and onto said duct immediately adjacent said transverse slot to reseal said duct; and means for rigidly mounting said cover plate to said duct.

2. A damper device according to claim 1, including a spacer plate adapted for location intermediate said cover plate and said duct to substantially uniformally conform said cover plate to said duct, and means mounting said spacer plate to said cover plate.

3. A damper device according to claim 2, wherein said spacer plate is mounted intermediate said cover plate and said sleeve.

4. A damper device according to claim 3, including a damper motor coupled to said damper drive shaft, including motor mounting means securing said damper motor to said cover plate.

5. A damper device according to claim 4, wherein said motor mounting means include a bracket mounted to said cover plate for supporting said damper motor.

6. A damper device according to claim 5, including a pair of stiffener members on said damper plate.

7. A damper device according to claim 6, wherein said stiffener members each comprise an elongated rib extending from adjacent said damper drive shaft outwardly on said damper plate.

* * * * *